US005281279A

United States Patent [19]

Gil et al.

[11] Patent Number: 5,281,279

[45] Date of Patent: Jan. 25, 1994

[54] PROCESS FOR PRODUCING REFINED SUGAR FROM RAW JUICES

[76] Inventors: Enrique G. Gil, Apartment #4, 392 Center St., Wallingford, Conn. 06492; Helene P. Wright, 117 S. Second Ave., Norwich, Conn. 06360

[21] Appl. No.: 787,591

[22] Filed: Nov. 4, 1991

[51] Int. Cl.[5] ..... C13J 1/06; C13D 3/12; C13D 3/16; C13F 1/02

[52] U.S. Cl. ..... 127/46.1; 127/55; 127/57; 127/58; 127/61

[58] Field of Search ..... 127/46.1, 46.2, 55, 127/57, 58, 61

[56] References Cited

U.S. PATENT DOCUMENTS

| | | | |
|---|---|---|---|
| 3,607,647 | 12/1971 | Hidi | 195/11 |
| 3,718,257 | 2/1973 | Bach | 210/73 |
| 3,785,863 | 1/1974 | Devillers et al. | 127/9 |
| 3,799,806 | 3/1974 | Madsen | 127/54 |
| 3,812,010 | 8/1974 | Nitsch | 435/94 |
| 3,853,616 | 12/1974 | Rundell et al. | 127/48 |
| 3,874,925 | 4/1975 | Loncin | 127/44 |
| 3,909,287 | 9/1975 | Rundell et al. | 127/57 |
| 3,926,662 | 12/1975 | Rundell et al. | 127/48 |
| 3,961,981 | 6/1976 | Pollio et al. | 127/46 |
| 3,982,956 | 9/1976 | Schoenrock et al. | 127/46 |
| 4,009,706 | 3/1977 | Shaughnessey | 127/48 |
| 4,039,348 | 8/1977 | Hunwick | 127/9 |
| 4,046,590 | 9/1977 | Riffer | 127/46 |
| 4,063,960 | 12/1977 | Paley | 127/42 |
| 4,081,288 | 3/1978 | Torres | 127/48 |
| 4,082,564 | 4/1978 | Fries et al. | 127/46 |
| 4,083,732 | 4/1978 | Paley | 127/48 |
| 4,111,714 | 9/1978 | Hippchen et al. | 127/46 |
| 4,116,712 | 9/1978 | Othmer | 127/46 |
| 4,135,946 | 1/1979 | Casey et al. | 127/11 |
| 4,140,541 | 2/1979 | Popper | 127/46 |
| 4,162,973 | 7/1979 | Lynch | 210/23 |

(List continued on next page.)

OTHER PUBLICATIONS

McGraw-Hill Series In Sanitary Science and Water Resources Engineering "Industrial Water Pollution Control" Eckenfelder pp. 52-61 (1966).

Meade-Chen "Cane Sugar Handbook", Eleventh Edition, James C. P. Chen pp. 161-167 (1985).

*Primary Examiner*—Nam Nguyen
*Assistant Examiner*—P. Hailey
*Attorney, Agent, or Firm*—DeLio & Peterson

[57] ABSTRACT

A process for producing refined sugar directly from plants of cane or beet raw juices which bypasses the traditional manufacturing of an intermediate product called "raw sugar". After treatment of the sugar juice with a flocculant, the juice has pressurized air dissolved in it, followed by rapid lowering of the pressure to ambient in a dissolved air flotation cell to separate impurities by aeration. Further amounts of flocculant are added, and the juice is passed through a serpentine flocculator comprising a pipe containing a plurality of relatively straight section interrupted by sharp bends to expose the juice sequentially to different turbulent regimes defined by different ranges of Reynolds numbers to form flocs containing undissolved solids. Flocs and other undissolved solids are separated from the juice by flotation and settling. The sugar juice or liquor is partially evaporated to a concentration between about 45° and 50° Brix to form a syrup, after which the syrup is again contacted with a flocculant. Following further treatment in the serpentine flocculator and dissolved air flotation cell, the remaining syrup is passed through filters such as silica sand, activated carbon and diatomaceous earth. The filtered syrup is contacted with ion exchange resins to decolorize and deash the syrup, and then it is evaporated to a concentration of 62°-64° Brix. Thereafter sugar is crystallized from the syrup.

The apparatus for separating undissolved impurities by flotation and settling passes sugar liquor between an assembly of closely spaced plates having corrugations in a direction perpendicular to the direction of flow of the liquor. The plates are disposed at an angle so that settled impurities may slide to the bottom of the assembly.

16 Claims, 5 Drawing Sheets

U.S. PATENT DOCUMENTS

| | | | |
|---|---|---|---|
| 4,196,017 | 4/1980 | Melville et al. | 127/41 |
| 4,211,579 | 7/1980 | Quentin | 127/46 |
| 4,234,350 | 11/1980 | Suzor | 127/48 |
| 4,247,340 | 1/1981 | Cartier | 127/48 |
| 4,252,571 | 2/1981 | Reilly | 127/9 |
| 4,288,551 | 9/1981 | Gudnason et al. | 435/168 |
| 4,288,619 | 9/1981 | Devos et al. | 562/554 |
| 4,312,678 | 1/1982 | Landis | 127/46 |
| 4,332,622 | 6/1982 | Hohnerlein, Jr. et al. | 127/41 |
| 4,382,823 | 5/1983 | Gudnason | 127/57 |
| 4,427,454 | 1/1984 | Oyama et al. | 127/44 |
| 4,432,806 | 2/1984 | Madsen et al. | 127/48 |
| 4,478,645 | 10/1984 | Gudnason | 127/57 |
| 4,502,890 | 3/1985 | Urbanic | 127/46 |
| 4,519,845 | 5/1985 | Ou | 127/46 |
| 4,523,960 | 6/1985 | Otte | 127/46.2 |
| 4,572,742 | 2/1986 | Kunin et al. | 127/46 |
| 4,603,000 | 7/1986 | Casey | 210/715 |
| 4,671,872 | 6/1987 | Cramer et al. | 210/219 |
| 4,680,119 | 7/1987 | Franklin, Jr. | 210/512 |
| 4,692,244 | 9/1987 | Supp et al. | 210/219 |
| 4,746,368 | 5/1988 | Frank et al. | 127/55 |
| 4,750,994 | 6/1988 | Schneider | 209/170 |
| 4,770,784 | 9/1988 | Davis et al. | 210/638 |
| 4,799,965 | 1/1989 | Bakker et al. | 127/46.2 |
| 4,871,397 | 10/1989 | Stevens | 127/55 |

FIG. 1
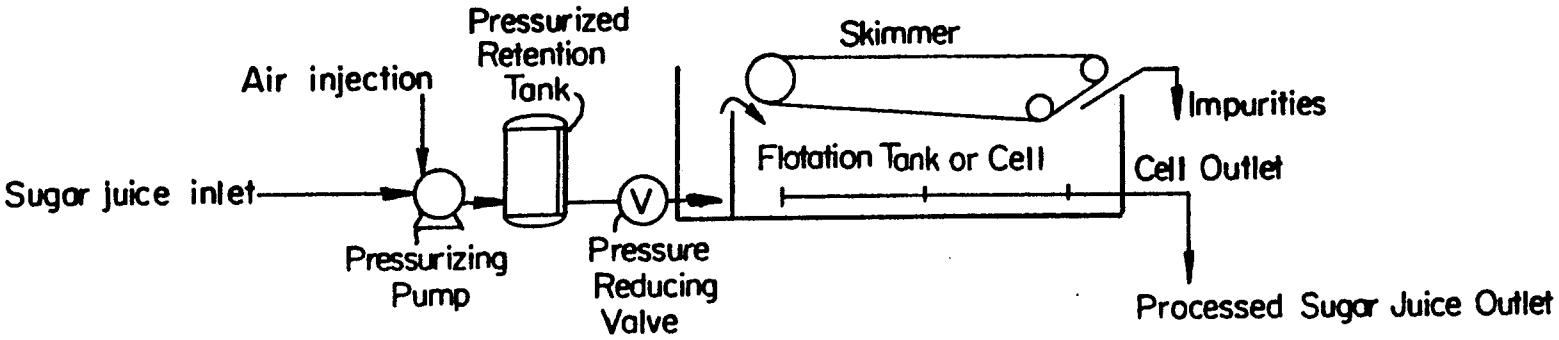
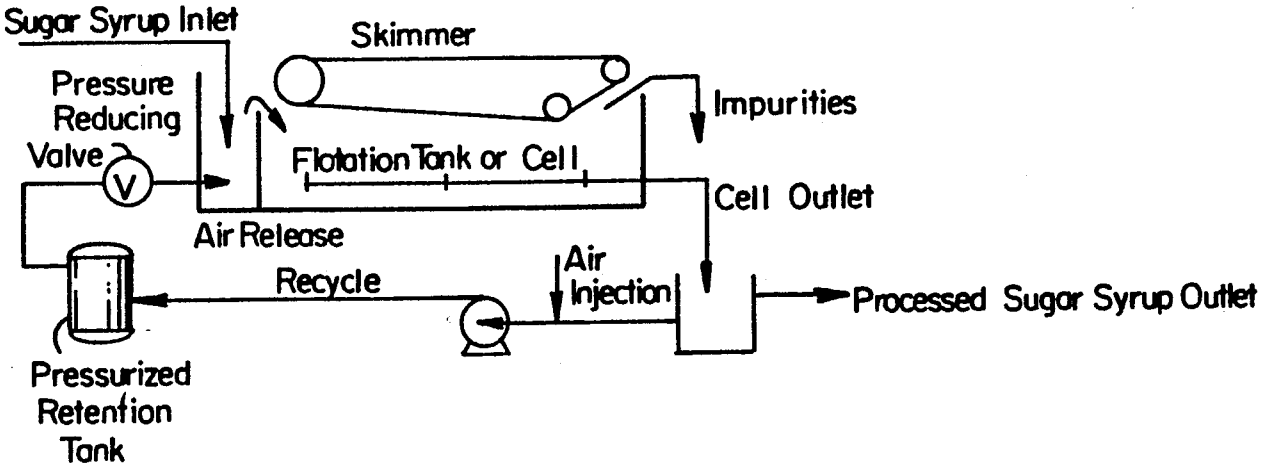
FIG. 2

PROCESS FOR PRODUCING REFINED SUGAR FROM RAW JUICES

BACKGROUND OF THE INVENTION

This invention is directed to a process for producing refined sugar from raw juices and an apparatus useful in such process to separate undissolved impurities from such juices.

The manufacture of refined sugar for human consumption begins with the treatment of dark colored juices which are extracted from plants. The raw juice may contain gums, waxes, proteins, organic acids, minerals, vegetable particles, sand, dirt, and other suspended solids. This manufacturing process primarily utilized in the prior art occurs in two main steps: (1) production of raw sugar, and (2) refinement of the raw sugar.

Meade and Chen, in their *Cane Sugar Handbook*, Eleventh Edition (John Wiley & Sons, 1985), disclose a process for the manufacturing of the raw sugar in which, after the extraction of the juice from the sugar cane or beet, hot or cold juices are treated with the addition of lime (calcium hydroxide). The line reacts with the organic acids in the juice when it is heated, by which flocculation insoluble flocs are formed. These are separated in a tray clarifier or multicell or some other device used in a "boiling house". Gravity forces the flocs with the most suspended solids to settle in the bottom of the tray while the clear juice is collected in the top of the tray. The juice is then evaporated in a multi effect system to 60°-62° Brix, and the concentrated syrup is then crystallized in a sugar pan. The crystals of raw sugar are then separated from the mother liquor by centrifugation. In many instances, the raw sugar crystals have impurities included inside the crystal.

The raw sugar is refined by washing the crystals with hot water to remove the film of syrup over the crystal. While more water gives better results, too much water can dissolve the sugar and decrease the yield of sugar. The sugar then is melted to begin the treatment. Most of the raw sugar refineries use phosphatation to remove parts of the impurities in the solution and also to remove some of the color bodies. Phosphoric acid and lime are added to the solution which is then heated in a clarifier, creating formation of insoluble flocs. Separation occurs when an air is pumped through the clarifier to rise the flocs to the surface of the solution. The clear liquor is then filtered to remove the remaining solids, and the scum is desweetened, to recover the sugar. Following this, the liquor is decolorized by contact with bone char, granular activated carbon or other absorbents, and, in some instances, ion exchange resins. When carbon beds are used, the carbon may lose its absorbent power and must be reactivated in a furnace. Ion exchange resins may be regenerated inside the chamber. After decolorization, the liquor is crystallized in a sugar pan, and sugar is separated from the mother liquor by centrifugation and is washed. The sugar is then dried in a continuous dryer and packed according to market needs.

There has been a long felt need in the industry to simplify the production of refined sugar and improve efficiency, but, to date, no such process has been developed which would be commercially viable. Given the problems and deficiencies of the prior art, it is therefore an object of the present invention to provide an improved process for refining sugar from raw juices which is simpler and more efficient than those in the prior art.

It is another object of the present invention to provide a process for refining sugar from raw juices which avoids the intermediate production and handling of raw sugar.

It is a further object of the present invention to provide a process for refining sugar from raw juices which utilizes methods and apparatus to reduce the time of production, including the time for removing undissolved impurities in sugar juices.

SUMMARY OF THE INVENTION

The above and other objects, which will be apparent to those skilled in the art, are achieved in the present invention which comprises, in a first aspect, a process for producing refined sugar directly from plants of cane or beet raw juices. During the process, a combined physical and chemical action takes place to remove the non-sugar substances and color, bypassing the traditional manufacturing of an intermediate product called "raw sugar", with the result of a significant reduction of time, materials, labor, losses, and heat, and the production of blackstrap molasses.

The process of the invention accomplishes the task with several main steps in its preferred embodiment:

a) initial treatment of the raw juice with chlorine or a chlorine-containing compound;
b) initial separation of the suspended solids;
c) treatment of the juice with at least one flocculant;
d) fast flow gravity separation of solids;
e) initial evaporation to form a syrup;
f) treatment of the syrup with at least one flocculant;
g) clarification and filtration of the syrup;
h) decolorization and deashing of the syrup;
i) final evaporation of the syrup;
j) crystallization of sugar; and
k) molasses disposal.

The process for producing sugar from raw sugar cane juices includes contacting the raw sugar cane juice with a flocculant, preferably one or more selected from the group consisting of hydrated lime, a source of phosphate ions such as phosphoric acid, and polyelectrolytes, such as polyacrylamides, and then separating any flocs from remaining juice.

In its preferred embodiment, the initial flocculation of the juice is preceded by treatment with chlorine or a chlorine containing compound, filtration, and aeration in a dissolved air flotation cell to separate impurities. Undissolved solids (including flocs) are separated from the juice by flotation and settling, preferably by passing the juice between closely spaced plates to permit undissolved solids to float and settle out. The sugar juice or liquor is partially evaporated to a concentration of less than about 50° Brix, preferably between about 45° and 50° Brix, to form a syrup, after which the syrup is again contacted with at least one flocculant, such as those described previously. Following separation of any flocs, the remaining syrup is passed through filters such as silica sand, activated carbon, diatomaceous earth, and combinations of the above. The filtered syrup is contacted with ion exchange resins to decolorize and deash the syrup, and then it is evaporated to a concentration of at least about 60° Brix, preferably 62°-64° Brix. Thereafter sugar is crystallized from the syrup. The process is marked by improvement in visual clarity of the sugar juice/syrup in each stage, especially in the initial stages prior to the first evaporation step.

In another aspect, the present invention provides a process of adding a flocculant to the raw sugar cane juice which is followed by passing the juice, liquor or syrup through a pipe containing a plurality of relatively straight section interrupted by sharp bends to expose the juice sequentially to different turbulent regimes defined by different ranges of Reynolds numbers to form flocs containing undissolved solids.

In yet another aspect, the invention comprises a process for removing sugar impurities from raw sugar cane juice by contacting the raw sugar cane juice with a flocculant to form flocs of impurities and pressurizing the juice above ambient pressure to introducing dissolved air into the juice. The pressure of the juice is then rapidly lowered to ambient to nucleate the dissolved air whereby the impurities are segregated from the juice by the action of the air bubbles. Other undissolved solids are separated from the juice by gravity.

In a further aspect, the present invention comprises a method of removing the flocs and other undissolved impurities from sugar juice or liquor by fast flow gravity separation in which the liquor is passed between closely spaced plates having corrugations in a direction perpendicular to the direction of flow of the liquor; heavier undissolved solids settle between the corrugations; and remaining sugar liquor is removed after passage between the plates. Lighter undissolved solids float to the surface where they are preferably skimmed off. For best effectiveness, the plates are disposed at an angle such that settled impurities may slide down the plates between the corrugations.

In yet another aspect, the invention provides an apparatus for removing undissolved impurities from sugar liquor by fast flow gravity separation comprising a tank having an inlet for receiving sugar liquor containing undissolved impurities and an assembly of closely spaced plates between which the liquor flows for receiving settling impurities. Preferably, the plates have corrugations in a direction perpendicular to the direction of f low of the liquor and have a spacing no greater than about 2 inches (50 mm). The plates are disposed at an angle so that settled impurities may slide to the bottom of the assembly. The tank includes an outlet for the purified sugar liquor. A rotatable blade is provided for skimming floating impurities from the surface of liquor in the tank, and a scraper is provided for removing settled impurities from the tank bottom.

In its preferred embodiment, the inlet for the apparatus is in a central position in the tank and includes a plurality of the plate assemblies disposed around the inlet for flow of the liquor in a substantially radial direction outward from the inlet. The outlet also may include a weir at the periphery of the tank over which purified liquor flows, and a baffle for preventing floating impurities on the surface of liquor in the tank from contaminating the purified liquor flowing over the weir.

BRIEF DESCRIPTION OF THE DRAWINGS

FIG. 1 is a schematic of the preferred dissolved air flotation cell, without recirculation, for removing impurities in one step of the invention.

FIG. 2 is a schematic of the preferred dissolved air flotation cell, with recirculation, for removing impurities in another step of the invention.

DETAILED DESCRIPTION OF THE INVENTION

Figure 3:
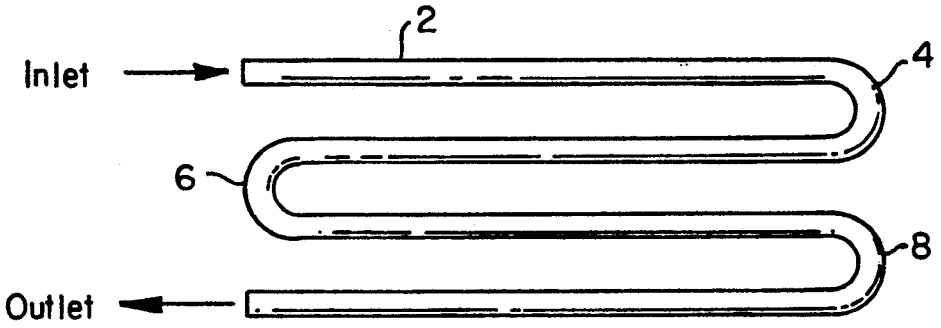
FIG. 3 is a schematic of the preferred serpentine flocculator of the present invention.

Briefly, the preferred process of the present invention involves removing color and impurities from a raw sugar-containing juice. Suspended solids in the raw juices are separated after flocculation in an air flotation cell at room temperature of about 80° F. (27° C.) in which air dissolved in the juice by pressurization is nucleated by lowering the pressure and allowing the air bubbles to segregate the insoluble solids. Following this, the juice is treated to remove the remaining solids. The juice is then combined with selected flocculant agents, and the solids are removed in a compact cross flow gravity separator, which will be described in more detail below. This separator has a very short detention time, approximately twenty (20) minutes, as compared to a conventional clarifier which may have a detention time of 90 minutes or more. The scum and mud impurities from the clarification are collected together and desweetened in a counter-current system. The clarified juice or liquor is partially evaporated in a conventional multi stage evaporator to form syrup. Such evaporators usually have four stages, and the first three stages may normally be used to reach a concentration of about 45° Brix.

The syrup may now be treated like a melted sugar by the method of phosphatation with the addition of phosphoric acid and lime. Optionally, other flocculants such as polyacrylamides are used to remove color and impurities. A dissolved air flotation cell is then employed to separate and remove the flocs by aeration by first pressurizing the juice to dissolve air therein and then releasing the pressure to form air bubbles which segregate the impurities. Any scum is desweetened using the same system which was used to desweetened the scum after the first clarification. The clear syrup is filtered in a sand filter and in filter traps with a mix of granular carbon and a filter aid. The sand used in the filter may be washed with a small volume of water. The clarified liquor or syrup is then decolorized and deashed, preferably in a combination of two ion exchange resins in a double bed chamber. Liquor is then crystallized in a conventional sugar pan, and the crystals are separated and washed in a centrifuge. The sugar crystals are dried and packed as is usually done in a sugar refinery.

The preferred processes, methods, and apparatus employed in the present invention are described in more detail below:

Pretreatment and Initial Separation of Suspended Solids

There may be more than 50 nonsugar impurities in the raw juice extracted from the sugar cane or beet plants, and most of these impurities are difficult to remove. Some directly or indirectly give color to the sugar solutions, either during the procedures or upon the juice being stored for extended periods of time. The impurities include gums, waxes, organic and non-organic acids, proteins, amino acids, minerals (such as potassium, magnesium, calcium, silica), vegetables, pith bacteria, and some colloids. Suspended solids should be separated from the juice early in the procedure to avoid the problems of increasing color, sucrose inversion, high viscosity and the generation of excess blackstrap molasses. Color in the sugar solutions is mainly attributable to caramel, melanodins and phenolics, the latter which may contribute more than 80% of the color of the solutions. Bacteria may also give color by inverting the sucrose into glucose and increasing the viscosity.

Typically, the sugar juice will initially have an initial purity of about 78–83%. When the sugar juices are heated, gums and waxes melt and are difficult to remove later. To avoid this problem and to eliminate problems with the bacteria in the juices, it is preferred that the juice be pretreated by adding chlorine or a chlorine containing compound, for example a chloride such as sodium chloride, in an amount of about 1–2 parts per million (ppm) of chlorine in soft water at room temperature in the mill or diffuser where the juice is extracted from the plant. The chlorine or chloride solution is preferably applied in all the areas where the circulation of the juice is not very active, and thereafter the solution is thoroughly mixed to kill the bacteria. At this same time, screens may be used to separate as many fine suspended solids as possible from the juices. Thereafter, hydrated lime—$Ca(OH_2)$—is preferably added to the juice as an aqueous solution or "milk" with an in-flow mixer until the pH reaches a level of about 6.8 to 7.2. The milk lime is preferably substantially free of impurities so as not to increase the level of non-sugar solids in the juices.

Figure 5:
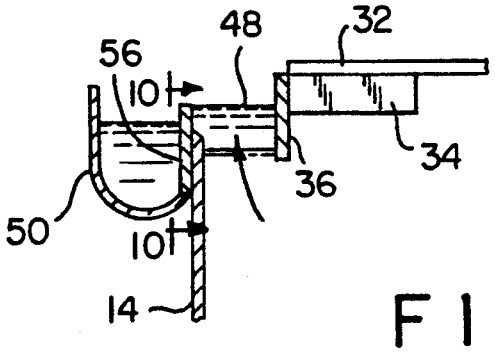
FIG. 5 is a close-up view of the overflow weir section for the clarified and purified sugar liquor in the apparatus depicted in FIG. 4.

A pump may then be used to transfer the juice to the pressure tank of a dissolved air flotation cell of the type used to treat waste water, as described by W. W. Eckenfelder, Jr. in *Industrial Water Pollution Control*, (McGraw-Hill, 1966), pp. 52–61 and FIG. 3–5, the disclosure of which is hereby incorporated by reference. A preferred dissolved air flotation cell, without recirculation, is shown in FIG. 1 and will be described in more detail below. The lime reacts with the natural acids contained in the juice and, by the agitation in the pump, forms flocs of insoluble solids. At the preferred treatment temperature in the range of about 90°–95° F. (32°–35° C.), the juice is pressurized at a preferred air pressure of 60 psig (0.4 MPa) in a pressurized retention tank. In a typical cell, clean air is added for 1–2 minutes at the rate of about 1 $ft^3$ (0.0283 $m^2$) of clean air for 250 gal. (950 l) of juice, when the suspended solids are in a typical range of 250 to 330 ppm. These values may be varied for other conditions.

There is typically a detention time in the pressure tank of at least about 3 minutes to dissolve the air, preferably to almost the point of saturation. Saturation of the air in water is proportional to the pressure and inversely proportional to the temperature. After the cell tank is so pressurized and saturated with air, the juice is passed through a pressure reducing valve to rapidly reduce pressure to ambient. The juice is then delivered to the air flotation tank or cell, typically at the rate of about 4 gal./min. per square foot (160 l/min per $m^2$) of surface area of the flotation cell. In this manner, there are nucleated very fine bubbles of air in the juice which tend to aerate and lift any suspended solids to the surface of the cell. Any solid scum floating at the surface is removed from the cell by a skimming device, and may be returned to the mill at the initial point of the process. Settled sludge or mud impurities may also be recycled.

Alternatively, other methods to remove solids may be utilized, for example, by the well known process of ultrafiltration. After this step of initially removing solids, preferably only about 7–9% of the suspended solids will remain in the juice.

Treatment of the Juice with a Flocculant

Figure 4:
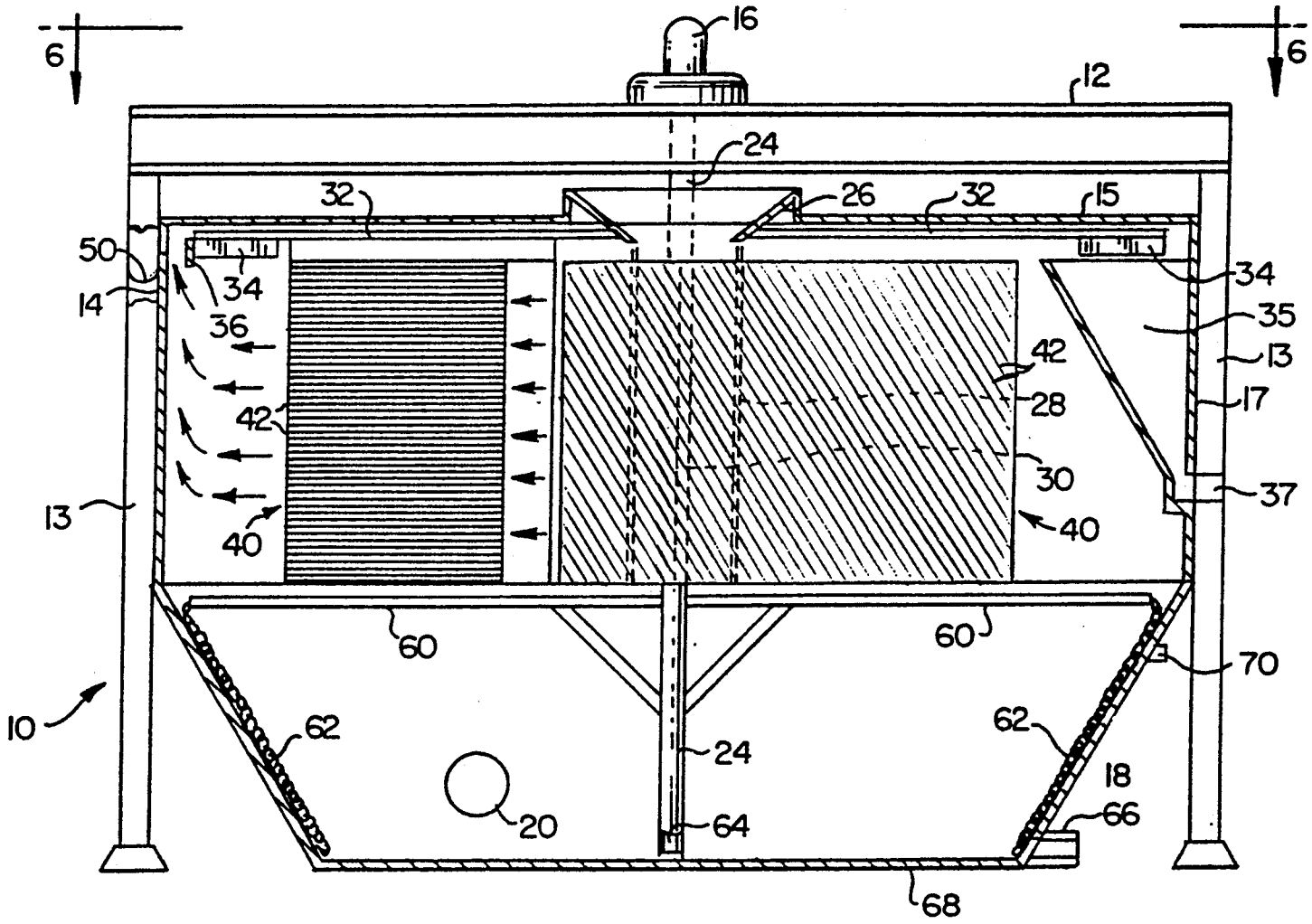
FIG. 4 is a side elevational view, partially in section, showing the preferred apparatus for clarifying and removing undissolved impurities from sugar juice or liquor which is processed according to the method of the present invention.
Figure 6:
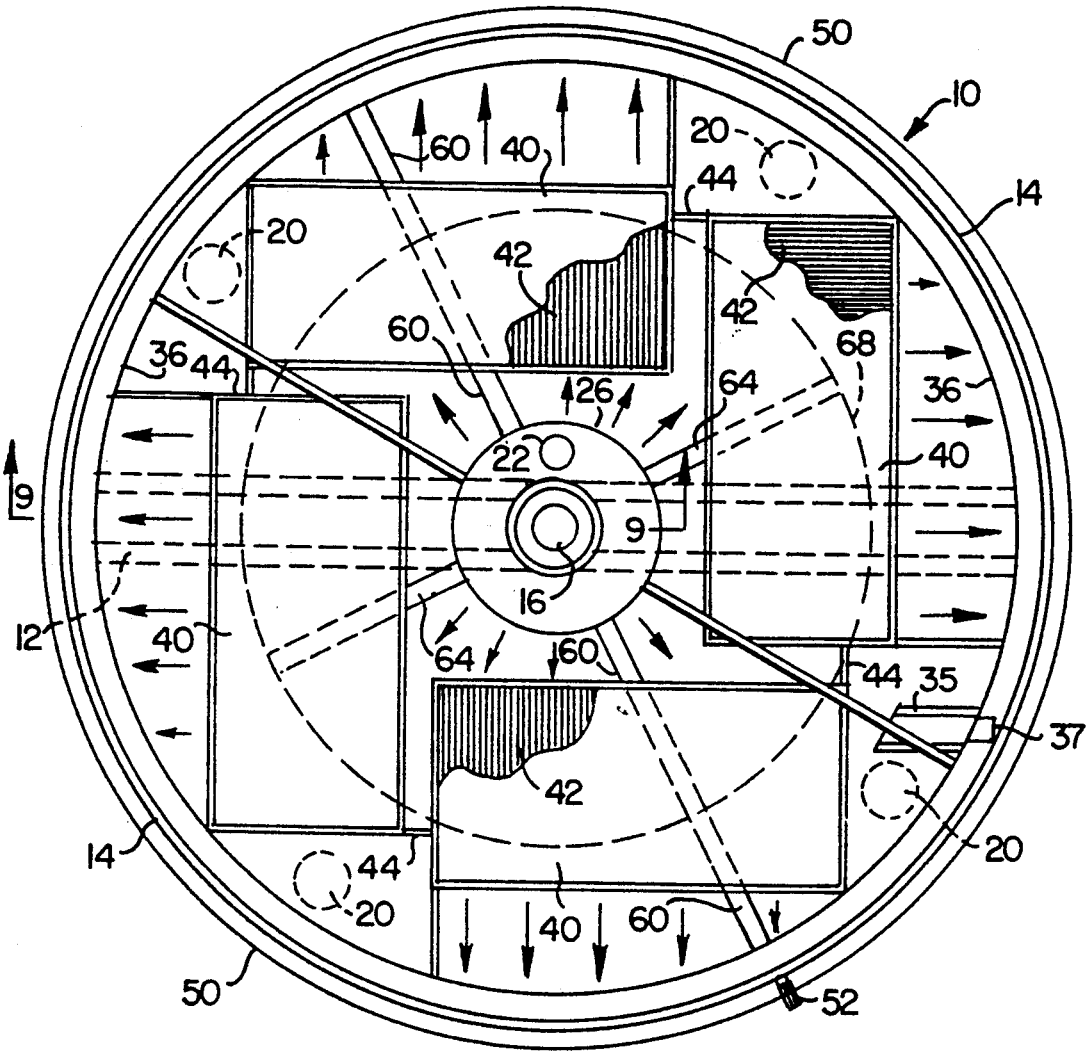
FIG. 6 is a top plan view, partially in section, of the apparatus depicted in FIG. 4.
Figure 9:
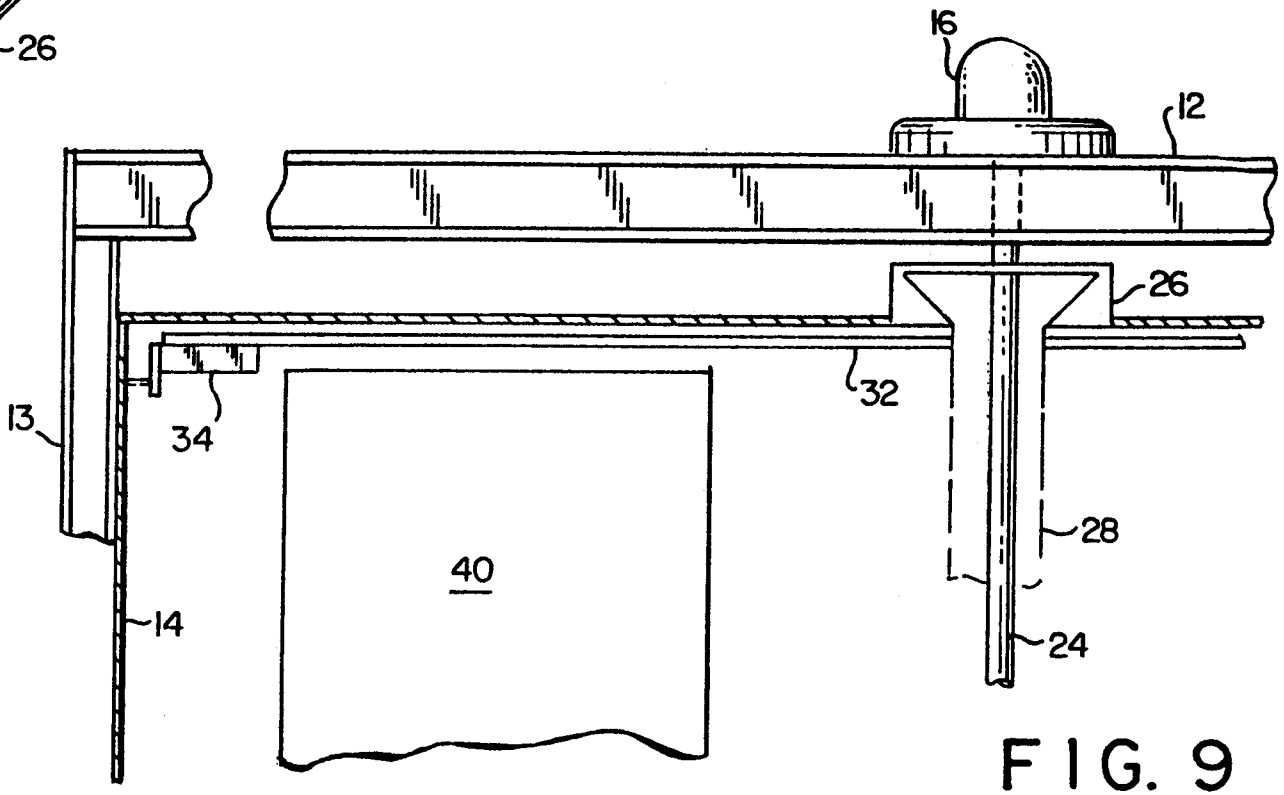
FIG. 9 is a cross sectional view of the top portion of the apparatus depicted in FIG. 6 along line 9—9.

To further remove the relatively small amount of solids remaining in the juice solution, about 150–200 ppm of phosphoric acid or other source of phosphate ion may then be added to the juice effluent from the flotation cell. The juice is then preferably heated to the range of about 200°–220° F. (94°–104°C.), after which lime is added until the pH of the juice reaches about 6.9 to 7.1. This treatment is conventionally known as phosphation of the sugar juice. The solution may then be flocculated, for example, in a serpentine flocculator as depicted in FIG. 3, which will be described in more detail below. This type of flocculator preferably has three different sections of pipe, each having different bores, with three sharp bends to impart three separate turbulent regimes having Reynolds numbers of about 4000–6000, about 6000–8000 and about 8000–10000, respectively. The flocculator is sized so that total detention time in the flocculator is typically about 2–3 minutes, with ⅓ of the time in each regime. The flocculator may be mounted on the side of the flotation cell to save space and minimize travel distance of the sugar juice in processing.

Optionally, and when necessary, clarification can be improved by the use of a conventional anionic polymer, such as any well known polyacrylamide used in sugar refining, in an amount of about 4–10 ppm. The polymer addition should preferably be performed with agitation in a separate tank, prior to treatment in the serpentine flocculator, with a detention time of about 15 minutes.

With either method, the insoluble flocs of solids should be removed from the juice by separation and segregation in a separate tank, preferably as described below.

Fast Flow Gravity Separation of Solids

Separation of the majority of remaining solids, including those formed by flocculation, is accomplished by gravity separation at a preferred temperature range of from about 180°–190° F. (82°–88° C.) in which lighter undissolved impurities are permitted to float to the surface, heavier undissolved impurities are permitted to settle to the bottom, and the sugar liquor or juice substantially purified of such impurities is collected for further processing. Conventional gravity separation apparatus such as multiple tray clarifiers may be employed, for example, the apparatus disclosed in the *Cane Sugar Handbook*, Eleventh Edition, pp. 161–167, and U.S. Pat. No. 3,718,257, the disclosures of which are hereby incorporated by reference. The preferred gravity separation apparatus is a novel fast flow gravity separator, depicted in FIGS. 4–10, which will be described in further detail below. The purpose of the design of this fast flow gravity separator or clarifier is to eliminate long detention times in order to improve the efficiency of the separation and to conserve sugar, thereby preventing inversions, increase in color and viscosity, and the detrimental effects of other impurities remaining in the juice.

During the operation of this type of clarifier, the time required for settling of heavier impurities is short because the impurities travel only about 1–2 inches (25–50 mm) before settling in the valleys of spaced corrugated plates. When particles of impurities descending down the valleys of the plates, the main flow of the juice is traveling horizontally in a different path than the particles. The novel fast flow gravity separator or clarifier of this invention is compact so that its installation requires less area and volume than a conventional clarifier. Additionally, it has a high efficiency of separation since it has the generally the same settling area as conventional tray clarifiers. However, because of the short detention time, the inversion of sugar and gain of color are minimal. The juice, which has been substantially separated of undissolved impurities and is now preferably water clear, is then sent to the evaporation system.

The floating scum and the settled sludge or mud containing the impurities together may be desweetened by conventional means such as in a countercurrent cycle as in described in U.S. Pat. No. 3,909,287, and the solution of the recuperated sugar from this cycle may be recirculated if desired to the gravity separation apparatus, and the remaining solids are discarded.

Initial Evaporation to Form a Syrup

Typically, the clear juice from the tray clarifier or gravity separator has a concentration from about 13° to 18° Brix. Unlike prior art methods which evaporate the sugar liquor or juice to a concentration of 60° Brix or more (as is usually done in a sugar refinery), the process of the present invention provides for evaporation of the juice to a concentration of between about 45° and 50° Brix, inclusive. It has been unexpectedly found that sugar juice solutions produced as above with a relatively low concentration of solids at this preferred concentration level are easier to handle in subsequent steps of the inventive process.

The majority of "boiling houses" in typical sugar mills employ multiple stage evaporator systems to evaporate the clear juice, such systems usually having four or more stages. Such conventional evaporators may be used in the present process, with the product of the evaporation being extracted before the last stage such that it has the desired concentration, preferably about 45°–47° Brix. Typical juice concentrations in a four (4) stage evaporator are as follows:

| Stage | Concentration |
|---|---|
| Juice | 13° Brix |
| After Body I | 26° Brix |
| After Body II | 36° Brix |
| After Body III | 46° Brix |
| After Body IV | 62° Brix |

Consequently, the concentrated juice may be removed as a syrup at the outlet of the third body with the desired concentration of about 45°–50° Brix. The evaporator system used with the process of the present invention will have less scale and longer operation in between cleaning shutdown because, unlike prior art processes, most of the suspended solids have been eliminated beforehand.

Treatment of the Syrup with a Flocculant

The partially evaporated, concentrated sugar syrup is then treated by contacting it with a flocculant, such as by adding phosphoric acid and lime, to produce flocs of solid impurities. This method of clarification by "phosphatation" may again include addition of a polyacrylamide (such as any in general use in sugar purification such as American Cyanamide's Magnifloc 846A, Dow Chemical's Separan AP30, or other anionic polymer), to increase the size of the flocs (or create a secondary floc in the solution after the first is formed) and to obtain better filterability after the treatment. The preferred temperature range for this step is about 170°–180° F. (77°–82° C.).

An in-line mixer may be used to add the phosphoric acid and the lime to the syrup. Preferably, phosphoric acid is added in an amount of about 150 to 300 ppm, based on the weight of sugar in the solution, and lime is added to reach a ph of 6.8 to 7.2. The flocculation is preferably accomplished in a serpentine flocculator, as previously described (FIG. 3).

A solution of the polyacrilamide is optionally added a separate tank as before with gentle agitation with a detention time of about 15 minutes. The polyacrilamide may be added in an amount up to about 15–30 ppm based on the weight of sugar in the solution.

Clarification of the Syrup

Clarification of the syrup is performed by segregation of the floc and other impurities, preferably by the process utilizing a dissolved air flotation cell with recirculation, as depicted in FIG. 2. The processing of the syrup through the dissolved air flotation is similar to that described previously for the juice, however, at this stage, the temperature of the syrup is preferably maintained in the range of about 185°–195° F. (85°–91° C.), instead of the lower temperatures used previously. The syrup is pressurized at 50–60 psig (0.34–0.41 MPa) with clean air to the point of saturation for 2–3 minutes and then the syrup is passed through a pressure reducing valve to nucleate the air throughout the syrup. The syrup impurities are again raised to the surface in a flotation cell by the flow of fine air bubbles, and a skimmer is used to sweep off and separate the scum. Detention time is typically 10 to 15 minutes in the cell. Treated syrup may be recirculated to increase the efficiency of the separation. The scum containing impurities may be returned to be mixed with the scum and other impurities of the gravity separation of the juice and desweetened in the same counter-current system.

Filtration of the Syrup

The clarified syrup is then filtered through a column containing a silica sand filter at a temperature of about 170°–180° F. (77°–82° C.). The sand preferably has a very high coefficient of uniformity, so that there are no layers of sand of different size. The preferred particle size of the sand is in the range of about 14–30 mesh (U.S. standard). The flow of the syrup through the sand filter can be from top to bottom or bottom to top. The volume of water needed to desweeten or backwash such sand is much less than with other types of filters, and consequently this type of filter reduces the losses of sugar because of the small volume of water used. The filtered syrup may then sent to a conventional trap filter which contains a mixture of activated carbon and diatomaceous earth which substantially removes any traces of chloride that can remain.

Final Decolorization and Deashing of the Syrup

Decolorization is the removal of the remaining "color bodies" from the syrup by passage through an ion exchange system. Almost all the color bodies contained in sugar solutions are believed to be anionic compounds which have a molecular weight range from the low hundreds to the high thousands. In practicing the preferred process of the present invention, it has been found that: (1) non-aromatic anion exchange resins can be useful to remove color bodies from solutions,, and (2) the colorant spectrum in some solutions requires more than one anionic resin to remove the color bodies.

The preferred process utilizes double bed chambers containing ion exchange resins, in a system similar to that used in the prior art. The preferred double bed chamber has an anionic resin such as Amberlite 958 in the upper chamber and a styrene resin such as Amberlite 900 in the lower chamber, both resins being of the macroreticular type and sold by Rohm & Haas. These beds have good absorbency and are in a continuous operation, with the detention time of the syrup being dependent upon the amount of color bodies in the solution to be removed and the final level of color desired. The ph of the solutions is preferably in the range of about 7.0 to 7.2, and the temperature is preferably no more than about 170° F. (77° C.) The flow rate may be about 0.5 to 0.7 gal/min. (1.9–2.6 l/min) through a bed 48 in. (1.2 m) high, and pressure drop can be from 8–10 psi (0.06–0.07 MPa). When the decolorization and deashing cycle is completed, the resins may be washed and desweetened by conventional means. Regeneration of the resins may be performed with a 10% sodium chloride solution inside the beds. Operation of the beds is simplified because of the low viscosity of the solution, and consequently the flow rate is high and pressure dropped low, compared to prior art methods.

Optionally, a combination of an ion exchange resin and an absorbent such as bone-char, granular carbon or carbon power may be used in a double bed chamber, as in U.S. Pat. No. 4,332,622, the disclosure of which is hereby incorporated by reference. This method removes the remainder of the ashes carried in the syrup before the decolorizing step. However, the use of such absorbents is generally a costly operation since at least 10% of the all volume of the absorbent are lost in each cycle or batch.

In general, the number and size of the chambers for ion exchange depend on the total flow rate of the selected refinery. The arrangement shown in U.S. Pat. No. 4,211,579 gives maximum utilization to the number of chambers, with minimum dilution of the solution.

Final Evaporation of the Syrup

After decolorization and deionization, the sugar liquor or syrup is water clear. The clear syrup is then returned to the final evaporation station of the evaporator described previously to be evaporated to reach a concentration of about 60°–62° Brix and a temperature of 195°–200° F. (91°–94° C.). Because of the relatively low temperatures employed in the previous steps of the process, the liquor generally does not gain any color due to caramelization. Also, scaling of the evaporator body is minimal because of the lack of minerals in the liquor evaporated.

Crystallization of Sugar

The crystallization of the sugar is performed according to well known to prior art methods in which sugar crystals are formed after a short evaporation. Meade and Chen, in the *Cane Sugar Handbook*, Eleventh Edition, Chapter 14, describe the systems that most of the refineries follow. According to their needs, the final product is a mix of dried crystals from first, second, third or fourth strikes, the number of strikes being based on the color of the previous one. The liquor from the centrifuge purge may be recirculated or returned to the above described treatment after initial evaporation, depending on its color and purity.

Molasses Disposal

If the product of the purge in the centrifuge which was separated from the sugar crystals does not reach acceptable color standards, molasses can be inverted and decolorized by conventional means to be sold as a by-product for human or industrial purposes.

Description of the Preferred Air Flotation Cells

The preferred dissolved air flotation cells for removing impurities from the sugar liquor according to the method of the present invention are depicted in schematic view in FIGS. 1 and 2. In both embodiments, a pressurizing pump is provided, in which clear atmospheric air is injected to pressurized the sugar juice or syrup which is then transferred to a retention tank where it is held under pressure. A pressure reducing valve reduces the pressure of the juice or syrup to ambient as the juice or syrup is transferred to the open top flotation tank or cell. A skimming device is provided to remove any impurities which float to the surface in the cell. Sludge or heavy .impurities settles to the bottom of the cell. The processed sugar juice or syrup is then removed from the cell for further processing. In the case of the flotation cell depicted in FIG. 2, processed sugar syrup may be recirculated and recycled back through the apparatus.

Description of the Preferred Serpentine Flocculator

Generally, the flocculator found most useful in practicing the method of the present invention has a plurality of straight tube or pipe sections interrupted by sharp bends to impart different degrees of turbulence and mixing to the sugar juice or syrup. It has been found that exposure of the mixture of flocculant and sugar juice or syrup to different turbulent regimes, as defined by significantly different ranges of Reynolds numbers, for sequential periods results in better floc formation throughout. The preferred serpentine flocculator used is depicted in schematic view in FIG. 3. The flocculator comprises a steel pipe 2 having straight sections separated by 180° bends 4, 6 and 8 which define three separate turbulent regimes, as defined by different ranges of Reynolds numbers, when sugar juice or syrup is flowed through the pipe. Alternatively, the flocculator may have more or fewer straight sections and/or bends to define a different number of turbulent flow regimes.

Description of the Preferred Fast Flow Gravity Separator

The preferred apparatus for clarifying and removing undissolved impurities from the sugar liquor according to the method of the present invention is depicted in FIGS. 4–10, in which like numerals refer to like features of the invention. The apparatus 10, also referred to as a cross flow gravity separator, comprises a horizontal beam or frame 12 mounted on vertical supports 13. Below the frame is a tank 14 having a generally cylindrical shaped upper section 17 and an inwardly converging conical shaped lower section 18 which terminates at base 68. The tank dimensions may be up to 25–40 ft. (7.6–12.2 m) or more in diameter, with a height up to about 15 ft. (4.6 m) or more. A feed box 26, centrally located in tank cover 15, receives the sugar liquor and has inwardly diverging side walls to permit flow downward to a cylindrical shaped feed well 28 below. Both the feed well and feed box are rotatably mounted on vertical shaft 24 which is driven by an electric motor in drive head 16. The rotation rate of shaft 24 is appropriately one revolution every 45–60 minutes. The feed well has four (4) vertically oriented slots 30 in its wall which extend substantially the full height of tank upper section 17 to distribute the sugar liquor evenly.

Figure 7:
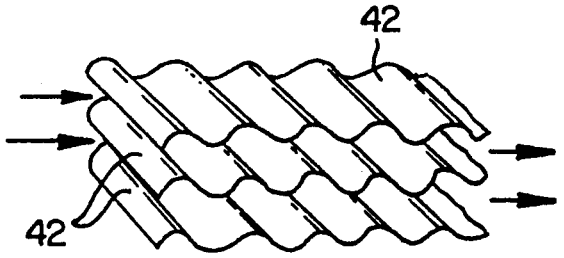
FIG. 7 is a perspective view of a section of the corrugated plate assembly utilized in the apparatus depicted in FIG. 4.

Disposed within tank 14 evenly about feed well 28 are four (4) plate assemblies 40. The plate assemblies 40 are intended to be totally immersed in the liquor within tank 14. The sugar liquor is distributed from the feed-well slot radially outward to the plate assemblies. Each plate assembly 40 contains a stack composed of a plurality spaced plates 42, the gap between adjacent plates being from about 1–2 inches (25–50 mm), preferably about 1–1½ inches (25–38 mm). The plates, which are preferably made of corrosion resistant materials such as plastic or stainless steel, are mounted at an approximately 60° angle to vertical and permit flow of sugar liquor through the assemblies. Baffles 44 are mounted on the sides of the plate assemblies to prevent sugar liquor from bypassing flow between the individual plates of the assemblies. As shown in detail in FIG. 4, each plate is corrugated, with undulations in cross section, such that the direction of the corrugation is perpendicular to the flow of liquor. The corrugations are preferably about 2 inches (50 mm) in height (the vertical distance between top and bottom crests, as seen in cross section) and about 4.5 inches (115 mm) in width (the horizontal distance between adjacent top crests, as seen in cross section), and have a smooth, sine wave type pattern as shown (FIG. 7). Any suspended impurities in the flowing liquor are permitted to settle out onto the plates in the trough of the corrugations, where they may slide down to the bottom of the plate assembly. The main flow of liquor across and between the plates over the top of the corrugations does not create excessive friction between the flow and does not substantially lower the sugar liquor flow rate.

Any scum or other floating impurities in the sugar liquor are permitted to flow to the top of the tank 14 either before or after passage through the plate assemblies. A pair of radial arms 32 extending outward from and rotatable with feed box 26 include downwardly extending blades 34 hinged to the arms. The blades contact the surface of the liquor and gently sweep any floating particles to a trough 35 located near the periphery of the tank. An outlet 37 is provided to remove any such floating impurities from the trough. A baffle 36 extends above the surface of the liquor 48 (see FIG. 5) and extends around the circumference of the tank to contain the floating impurities in the central portion of the tank.

Figure 10:
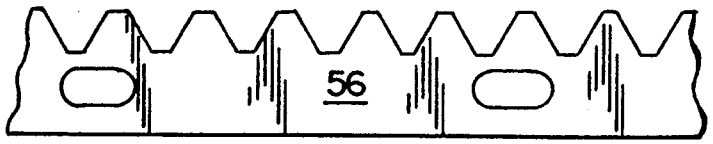
FIG. 10 is a side elevational view of a portion of the adjustable weir of the apparatus depicted in FIG. 5 along line 10—10.
Figure 8:
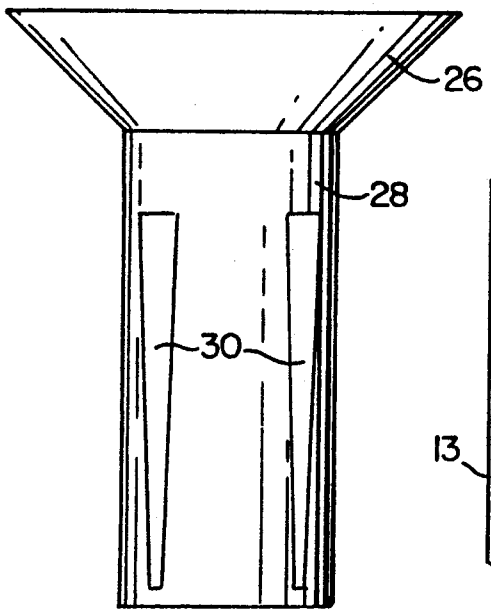
FIG. 8 is a side elevational view showing the feed well of the apparatus depicted in FIG. 4.

After passage of the sugar liquor through the plate assemblies, the liquor (now purified of a substantial portion of its suspended impurities) exits near the periphery of the tank and flows upward and over the top edge of tank 14 on which is mounted an adjustable weir 56 having a sawtooth shaped top edge (FIG. 10). As described previously, baffle 36 prevents any floating impurities from contaminating the flow of clarified and purified liquor over weir 56. The clear overflow of the liquor collects in a "U" shaped trough 50 which extends around the periphery of the tank. An outlet portion 52 is provided to remove the clarified liquor.

Heavier sludge or mud impurities which are collected within the corrugations in the individual plates 42 fall out from the bottom of the plate assemblies 40 and are collected at the bottom of tank portion 18. To assist in keeping the tank bottom clean, a pair of rotatable radial arms 60 disposed just below the plate assemblies drag a pair of chains 62 which scrape the converging angle surfaces of tank portion 18 of any settled impurities.

Likewise, a pair of radial extending arms 64 at the bottom 68 of the tank (set 90° to arms 60) keep the impurities from adhering to the tank bottom. An outlet 66 is provided for flushing out the settled impurities of the liquor. Both arms 60 and 64 are driven from the same shaft 24 which rotates the upper portions of the assembly. An additional outlet 70 is provided for a general cleaning of the tank. Additionally, hole covers 20 are provided at location indicated at the tank cover and at the bottom of the tank to inspect and clean the apparatus.

The apparatus shown in the drawings has the advantage of reducing detention time of the sugar liquor to as short as 20 minutes so that the color remains the same and no losses occur due to inversion of the sugar. The apparatus also has relatively high efficiency in separating the undissolved impurities as compared to prior art separating apparatus.

EXAMPLE

The following non-limiting example is set forth to demonstrate the preferred embodiment of the present invention.

Initially, 100 l of raw sugar cane juice with a purity of about 80% was sprayed with 80 ml of a solution of sodium chloride in soft water at room temperature to obtain 1–2 ppm of $Cl_2$. This was followed by the addition of 1.6 g of hydrated lime with an in-liner mixer to bring the juice to a ph of 7.0.

The juice was then transferred to a retention tank under pressure of 60 psig (0.41 MPa), mixed with clean air for 3 minutes to dissolve the air in the juice, and then fed to a dissolved air flotation cell of the type shown in FIG. 1. The air intake delivered about 12.5 l of oilless air into the system for 100 gal/min (380 l/min) of juice, based on an average of suspended solids in the juice in the range of 250 to 300 ppm. The flow rate in the cell was 4 gal/min (15 l/min) based on 1 $ft^2$ surface area of the flotation cell. Detention time in the cell was 15 minutes at a temperature at 2° C. above room temperature. As a result of the rapid release of pressure, the fine air bubbles raised suspended solids to the surface of the cell where they were skimmed off.

Phosphoric acid ($H_3PO_4$) was then added to the effluent of the flotation cell in an amount of 3 g, and the juice was then heated to 200° F. (93° C.), after which 4.5 g of hydrated lime was added to reach a ph of 7.1. After addition of 2 ppm of an anionic polyacrylamide, the solution was passed through a serpentine flocculator, which had three different sections in the pipes with sharp bends to have three turbulent regimes to reach Reynolds numbers of 4000 to 6000, 6000 to 8000, and 8000 to 10000, respectively. Detention time in the serpentine flocculator was 4 minutes.

The juice was then transferred to a fast flow clarifier of the type shown in FIGS. 4–10. The temperature was 190° F. and the detention time was 20 minutes. The clarified juice was then evaporated to a concentration of 45° Brix. Phosphoric acid in an amount of 3 g and hydrated lime in an amount of 4 g were added to the syrup from the evaporator. The pH of the syrup was 7.0. The syrup was then passed through the serpentine flocculator of the type described previously. Detention time in the flocculator was 3 minutes.

Clarification took place in a dissolved air flotation cell of the type shown in FIG. 2 with recirculation of the 30% of the flow rate. An anionic polyacrylamide was added in an amount of 2 ppm of the syrup. The cell automatically maintained the temperature of the syrup between 175° and 185° F. (80° and 85° C.), while the pump recirculated part of the flow to bring the solution to the pressure tank which was at 60 psig (0.41 MPa). About 12.5 l of oilless air into the system for 100 gal/min of syrup. Detention time was 15 minutes in the tank, following which the pressure was released as the syrup passed to the flotation cell. Very fine bubbles of nucleated air raised the flocs along with the insoluble solids in the solution, which were then skimmed off. The clarified syrup was then filtered in a silica sand filter and in a trap filter, the latter being in a mix of activated carbon and diatomaceous earth, at a temperature of 165°–175° F. (74°–80° C.).

The filtered syrup was then processed in a column containing ion exchange resins, the top having an anionic resin and the bottom a styrene resin, both of the macroreticular type. The height of the bed was 48 inches (1.2 m) and the flow rate was 0.5 gal/min. The pH of the solution was 6.9 and the temperature was 180° F. (82° C.). After the completion of the decolorization cycle, the syrup was evaporated to a concentration of 62° Brix and the temperature was raised to 190° F. (88° C.). The syrup was then crystallized in a conventional sugar pan and was determined to have a purity of 99.4%.

Thus, the present invention has been shown to provide a simpler and more efficient process for removing impurities and refining sugar from raw juices than those in the prior art, and which avoids the intermediate production and handling of raw sugar. Furthermore, the present invention utilizes methods and apparatus to reduce the time of production, including the time for removing undissolved impurities in sugar juices.

While the invention has been described herein with reference to specific embodiments, it will be recognized by those skilled in the art that variations are possible without departing from the spirit and scope of the invention, and that it is intended to cover all changes and modifications of the invention disclosed herein for the purposes of illustration which do not constitute departure from the spirit and scope of the invention.

Having thus described the invention, what is claimed is:

1. A process for producing sugar from raw sugar cane juice comprising the steps of:

a) contacting the raw sugar cane juice with a flocculant;

b) separating undissolved solids from the juice;

c) partially evaporating the juice to a concentration of no greater than about 50° Brix to form a syrup;

d) contacting the syrup with a flocculant;

e) separating any flocs from remaining syrup;

f) filtering the remaining syrup;

g) contacting the filtered syrup with an ion exchange resin to decolorize and deash the syrup;

h) evaporating the syrup to a concentration of at least about 60° Brix; and i) thereafter crystallizing sugar from the syrup.

2. The process of claim 1 wherein the evaporation of step (c) is to between about 45° and 50° Brix.

3. The process of claim 1 wherein the flocculant used in step (a) is selected from the group consisting of lime, a source of phosphate ions, polyelectrolytes, and combinations of the above.

4. The process of claim 1 including the steps of separating the flocs from the juice between steps (a) and (b) in a dissolved air flotation cell by pressurization of the juice above ambient pressure and rapid release of pressure to produce aeration.

5. The process of claim 1 wherein undissolved solids are settled and separated in step (b) by:

i) passing the juice between closely spaced plates having corrugations in a direction perpendicular to the direction of flow of the juice;

ii) settling undissolved solids between said corrugations; and;

iii) removing remaining sugar juice after passage between said plates.

6. The process of claim 5 wherein said plates are disposed at an angle such that settled impurities may slide down said plates between said corrugations.

7. The process of claim 1 wherein the syrup is filtered in step (f) through a silica sand filter.

8. A process for producing sugar from raw sugar cane juice comprising the steps of:

a) contacting the raw sugar cane juice with a flocculant;

b) separating any undissolved solids from the juice by:

i) passing the juice between closely spaced plates having corrugations in a direction perpendicular to the direction of flow of the juice, said corrugations having alternating to and bottom crests;

ii) settling undissolved solids within the bottom crests between said corrugations; and;

iii) removing remaining sugar juice after passage between said plates;

c) partially evaporating the juice to a concentration of between about 45° and 50° Brix to form a syrup;

d) contacting the syrup with a flocculant;

e) separating any flocs from remaining syrup;

f) filtering the remaining syrup;

g) contacting the filtered syrup with an ion exchange resin to decolorize and deash the syrup;

h) evaporating the syrup to a concentration of at least about 60° Brix; and i) thereafter crystallizing sugar from the syrup.

9. The process of claim 8 wherein, between steps (a) and (b), impurities are removed from the raw sugar cane juice by:

i) contacting the raw sugar cane juice with a flocculant to form flocs of impurities;

ii) pressurizing the juice above ambient pressure to introduce dissolved air into the juice;

iii) lowering the pressure of the juice to nucleate the dissolved air whereby the impurities are segregated from the juice; and iv) separating undissolved solids from the juice by gravity.

10. A process for removing impurities from raw sugar cane juice comprising the steps of:

a) contacting the raw sugar cane juice with a flocculant to form flocs of impurities;

b) pressurizing the juice above ambient pressure to introduce dissolved air into the juice;

c) rapidly lowering the pressure of the juice to nucleate the dissolved air whereby the impurities are segregated from the juice; and d) separating undissolved solids from the juice.

11. The process of claim 10 further including the steps of:

e) contacting the juice with a flocculant;

f) passing the juice between closely spaced plates having corrugations in a direction perpendicular to the direction of flow of the juice, said corrugations having alternating top and bottom crests;

g) settling undissolved solids within the bottom crests between said corrugations; and h) removing remaining sugar juice after passage between said plates.

12. The process of claim 10 further including, prior to step (a), the step of contacting the raw sugar cane juice with a chloride solution, and, following step (d), the steps of:

e) contacting the juice with a flocculant;

f) passing the juice between closely spaced plates having corrugations in a direction perpendicular to the direction of flow of the juice, said corrugations having alternating top and bottom crests;

g) settling undissolved solids within the bottom crests between said corrugations;

h) removing remaining sugar juice after passage between said plates;

i) partially evaporating the juice to a concentration of between about 45° and 50° Brix to form a syrup;

j) contacting the syrup with a flocculant;

k) separating any flocs from remaining syrup;

j) filtering the remaining syrup;

m) contacting the filtered syrup with an ion exchange resin to decolorize and deash the syrup;

n) evaporating the syrup to a concentration of at least about 60° Brix; and o) thereafter crystallizing sugar from the syrup.

13. A method of removing undissolved impurities from sugar liquor comprising the steps of:

a) passing the liquor between closely spaced plates having corrugations in a direction perpendicular to the direction of flow of the liquor, said corrugations having alternating top and bottom crests;

b) settling undissolved solids within the bottom crests between said corrugations; and;

c) removing remaining sugar liquor after passage betwen said plates.

14. The method of claim 13 wherein said plates are disposed at an angle such that settled impurities may slide down said plates within the bottom crests of said corrugations.

15. A process for producing sugar from raw sugar cane juice comprising the steps of:

a) contacting the raw sugar cane juice with a flocculant;

b) passing the raw sugar cane juice through a pipe containing a plurality of bends to expose the juice sequentially to different turbulent regimes defined by different ranges of Reynolds numbers to form a floc containing undissolved solids c) separating undissolved solids from the juice;

d) partially evaporating the juice to a concentration of no greater than about 50° Brix to form a syrup;

e) contacting the syrup with a flocculant;

f) separating any flocs from remaining syrup;

g) filtering the remaining syrup;

h) contacting the filtered syrup with an ion exchange resin to decolorize and deash the syrup;

i) evaporating the syrup to a concentration of at least about 60° Brix; and j) thereafter crystallizing sugar from the syrup.

16. A process for removing impurities from raw sugar cane juice comprising the steps of:

a) contacting the raw sugar cane juice with a flocculant to form flocs of impurities;

b) exposing the raw sugar cane juice sequentially to different turbulent regimes defined by different ranges of Reynolds numbers to form flocs containing undissolved solids c) pressurizing the juice above ambient pressure to introduce dissolved air into the juice;

d) rapidly lowering the pressure of the juice to nucleate the dissolved air whereby the impurities are segregated from the juice; and e) separating undissolved solids from the juice.

* * * * *

UNITED STATES PATENT AND TRADEMARK OFFICE

CERTIFICATE OF CORRECTION

PATENT NO. : 5,281,279

DATED : January 25, 1994

INVENTOR(S) : Gil et al.

It is certified that error appears in the above-identified patent and that said Letters Patent is hereby corrected as shown below:

Column 15, line 54, "j" should read --1--.

Signed and Sealed this

Thirteenth Day of September, 1994

*Attest:*

*Attesting Officer*

BRUCE LEHMAN

*Commissioner of Patents and Trademarks*